United States Patent [19]

Barnes et al.

[11] 4,159,926

[45] Jul. 3, 1979

[54] NICKEL PLATING

[75] Inventors: Clive Barnes; John J. B. Ward, both of Wantage, England

[73] Assignee: BNF Metals Technology Centre, England

[21] Appl. No.: 856,158

[22] Filed: Nov. 30, 1977

[30] Foreign Application Priority Data

Dec. 3, 1976 [GB] United Kingdom ..... 50607/76

[51] Int. Cl.[2] ..... C25D 3/12

[52] U.S. Cl. ..... 204/49

[58] Field of Search ..... 204/49, 41; 106/1.27

[56] References Cited

U.S. PATENT DOCUMENTS

| | | | |
|---|---|---|---|
| 2,449,422 | 9/1948 | Smith | 204/49 |
| 2,726,969 | 12/1955 | Spaulding | 106/1.27 X |
| 2,782,152 | 2/1957 | DuRose et al. | 204/49 |
| 3,062,666 | 11/1962 | McLeod | 106/1.27 |
| 3,417,005 | 12/1968 | Baig | 204/49 X |
| 3,620,936 | 11/1971 | DeCastelet | 204/41 |
| 3,901,773 | 8/1975 | Lugwig | 204/41 |

FOREIGN PATENT DOCUMENTS

| | | | |
|---|---|---|---|
| 11207 | 8/1962 | Japan | 204/49 |

OTHER PUBLICATIONS

H. Koretzky, IBM Tech. Disclosure Bulletin, p. 1634, vol. 9, No. 11, Apr. 1967.

*Primary Examiner*—G. L. Kaplan

*Attorney, Agent, or Firm*—Wenderoth, Lind & Ponack

[57] ABSTRACT

A nickel electroplating bath comprises in aqueous solution at a pH of from 4 to 7, nickel ions at a Molar concentration of at least 0.25, chloride ions at a Molar concentration of at least 0.25, and a weak complexant for the nickel selected from formate, acetate, citrate, glutamate, anions and lactones of sugar acids and anions and lactones of acids having the formula $X(C_nH_{2n})COOH$ where X is OH or $NH_2$ and n is 1 to 5, preferably 1 to 2, present at a Molar concentration of from 0.5 to 4.0 times that of the nickel. These baths have good throwing power and can be operated at convenient temperatures and pH values and at lower nickel ion concentrations than hitherto.

7 Claims, No Drawings

NICKEL PLATING

This invention relates to electroplating with nickel. Nickel plating is carried out commercially on a very large scale on substrates of copper, copper-plated zinc, brass and steel, and itself serves as a substrate for decorative chromium plating. Typical commercial nickel plating conditions involve the use of an electrolyte containing 1.1 Molar nickel at a pH of from 3 to 4, a temperature of 50°-60° C., and a current density at the cathode of 430 Amps per square meter or more. Under these conditions, nickel substantially obeys Faraday's laws; that is to say, a doubling of the current density results in a doubling of the rate of electrode position of nickel on the cathode. It follows that, when objects of complex shape are electroplated with nickel, the thickness of the nickel deposit is higher on accessible areas than on inaccessible areas, i.e. the throwing power of the electrolyte is poor. Since it is normally necessary that the entire object be covered with at least a minimum thickness of nickel plate, it has hitherto been the practice to provide a much thicker nickel coating on certain areas than is strictly necessary. This wastes nickel. As the price of nickel increases and the metal becomes scarce, this problem grows in importance.

Problems arise in nickel plating solutions when the nickel concentration is too low. Local depletion of nickel ions occurs, the pH rises and nickel precipitates out of solution. The nickel concentration necessary to avoid these difficulties is about 30 grams per liter, but prior commercial nickel plating solutions have generally been operated with a considerable margin of safety, by maintaining the nickel concentration at not less than 60 grams per liter. Since nickel is the major ingredient, as regards cost, in the bath, this practical requirement virtually doubles the cost of the bath over what is theoretically necessary.

Conventional nickel plating baths are normally operated at a temperature in the range of 50°-60° C.; these elevated temperatures are used to improve the conductivity of the bath and to avoid any problems resulting from precipitation of nickel out of solution, but they increase the cost of the operation.

Conventional nickel plating baths are normally operated at a pH in the range of 3 to 4. This pH range is chosen to avoid problems arising from nickel precipitation, though it is otherwise more acid than would be desired.

It is an object of the present invention to provide a nickel plating solution which overcomes these disadvantages.

The present invention provides a nickel electroplating bath comprising in aqueous solution at a pH of from 4.0 to 7.0:

| Constituent | Molar Concentration |
|---|---|
| Nickel ions | at least 0.25 |
| Chloride | at least 0.25 |
| Sulphate (optional) | less than chloride |

and a weak complexant for the nickel selected from formate, acetate citrate, glutamate, anions and lactones of sugar acids, e.g. polyhydroxy C5 and C6 acids, and anions and lactones of acids having the formula $$X(C_nH_{2n})COOH$$

where

X is OH or $NH_2$ and n is 1 to 5, present at a molar concentration of from 0.5 to 4.0 times that of the nickel.

The improved throwing power of these solutions is not apparent below pH 4. As the pH of the solution is raised, above pH 6.5, the nickel precipitates out, and indeed it is necessary to be able to precipitate nickel from the solution at a pH not greater than 9 so as to enable it to be removed by conventional effluent treatment. We can operate our plating solutions at any pH from 4.0 up to 7.0 (or the pH at which nickel is precipitated; whichever is the less). We prefer to operate at a pH of from 4.6 to 6.5, the improvements in throwing power being particularly marked above 5.5. The use of a complexant according to the present invention mitigates the difficulties arising from low nickel concentration, with the result that out solutions can be safely operated at a nickel concentration as low as 30 grams per liter. This is advantageous, since it reduces the capital cost of the nickel in the plating bath. In plating solutions according to the present invention, the nickel ion concentration is at least 0.25M, preferably from 0.25 to 1.0M, particularly from 0.3 to 0.6M. Nickel is generally used as the chloride but, the nature of the anion is not critical.

Surprisingly, the improvement in throwing power resulting from our weak complexants for nickel is much more marked in chloride solutions than in sulphate solutions. Sulphate solutions have the further disadvantage, compared to chloride solutions, that nickel electrodeposits formed at high current density are burnt and brittle. For these reasons, we specify that the chloride concentration of our solutions is at least 0.25 Molar, preferably at least 0.60 Molar; and that sulphate, if present, is present at the Molar concentration less than the chloride, preferably less than one third of the chloride, preferably less than 0.75 molar and particularly less than 0.25 Molar.

As a weak complexant for the nickel, there may be added to the electroplating bath the acid of one or more of the anions noted above or a salt of such acid with a base whose cation is inert in the electroplating bath, for example an alkali metal. It is believed to be the anion that complexes the nickel, for these acids are very substantially dissociated on addition to aqueous solutions of nickel salts.

Preferred are those complexants which are capable of chelating the nickel by means of a bidentate ligand involving the formation of a 5- or 6-membered ring, i.e. compounds of the given formula where n is 1 or 2, that is to say, glycine, alanine, glycolic acid and lactic acid.

Our preferred complexing agent is glycolic acid, which has the following outstanding advantages:

(a) At quite moderate concentrations it enables nickel deposition rates to be maintained constant with varying current density above a chosen critical figure, usually around 400 Amps per square meter;

(b) the quality of the electrodeposited nickel is uniformly good over the entire range of current densities;

(c) it is easily possible to precipitate nickel from solutions containing glycolate for effluent treatment purposes; and (d) at the concentrations needed to improve throwing power, it does not significantly reduce current efficiency at current densities below the chosen critical figure.

The other preferred complexants possess these particular qualities to varying degrees. Glycine can be used at moderate concentrations to improve throwing power above a critical current density without significantly reducing current efficiency below that critical current density. Citric acid and lactic acid can be used at reasonable concentrations to improve the throwing power and give rise to good quality deposits, while nickel can readily be precipitated from solutions containing them for effluent treatment. Glutamic acid, conveniently used in the form of monosodium glutamate, exhibits very good throwing power, but only at rather high concentrations; the electrodeposit quality is good and no effluent treatment problems arise. Acetic and formic acids are effective at high concentrations to provide electroplating solutions of good throwing power which form a nickel deposit of good quality and do not give rise to effluent disposal problems. Gluconic acid and gluconolactone are effective at moderate concentrations to provide electroplating solutions of good throwing power which form a nickel deposit of good quality and do not give rise to effluent disposal problems.

Acetate, formate and glutamate are preferably used at a Molar concentration of from 1 to 4 times that of the nickel. The other complexants may advantageously be present in a Molar concentration of 0.5 to 2.0, preferably 0.5 to 1.0 times the Molar concentration of nickel. At complexant concentrations below 0.5 times the Molar concentrations of nickel, little stabilising effect, and little improvement in throwing power, is seen. One mole of complexant per mol of nickel is believed just sufficient to complex all the nickel. The upper end of the concentration range for complexant is not critical, but a high concentration of complexant reduces the plating efficiency of the bath.

The threshold cathodic current density at which a complexant just starts to reduce nickel plating efficiency, varies with several factors; the nature of the complexant, since the complexants have different powers of complexing with nickel; the concentration of the complexant; the temperature of the bath; and the pH of the bath. It should therefore be possible to correlate these parameters so as to start to reduce the efficiency of nickel electrodeposition at a chosen cathodic current density. A preferred course of action involves making up a desired plating solution and then controlling its throwing power by adjusting the pH and/or temperature of the bath. In general, the higher is the pH, the more effective is the complexant. In general also, the lower is the bath temperature, the more effective is the complexant. We prefer to use the minimum practicable concentration of complexant and to compensate by adjusting pH and temperature.

Other ingredients may be included in the nickel electroplating bath, in the same way as for conventional baths. Boric acid may be included to improve buffering power; it is normally used in saturated solution, i.e. at a concentration of 30–60 grams per liter. Conductivity salts, generally alkali metal chlorides may be included at concentrations up to 2 Molar, though preferably less than 1 Molar, to increase the conductivity of the solution and hence to reduce the heat generated during electroplating. Organic wetting agents and levelling and brightening agents, for example, butyne diol, coumarin, para-tolouene sulphonamide, and others may be used in the usual concentrations in the usual way.

The invention also includes a method of electrodepositing nickel on an object having a metallic surface, which method comprises providing a nickel electroplating bath as hereinbefore defined, providing the object as a cathode to be plated in the bath, and an anode, and passing an electric current between the anode and cathode.

We envisage particularly plating on substrates of copper, copper-plated zinc, brass and steel to a thickness of at least 10 microns. British Standard 1224 of 1975 calls for a nickel film thickness of at least 20 microns as a substrate for chromium. Some hold the view that, on 12.5 microns copper-coated zinc, a nickel film thickness of 15 microns is sufficient, but it is agreed that the chromium must then be deposited under carefully controlled conditions. At film thicknesses of this sort, conductivity salts are necessary for economic operation.

Our plating baths can be operated satisfactorily at any temperature from ambient upwards, though we prefer to operate in the range 35° to 50° C.

The anode preferably consists of or comprises nickel. When the complexant reduces the nickel plating efficiency at high current densities, the effect is that hydrogen is generated instead of nickel at the cathode. In the circumstances, an anode consisting wholly of nickel would be liable to cause the nickel concentration of the plating solution to increase with time, and it may be preferable to balance the anode, for instance by providing a subsidiary anode of graphite or other inert material. In order to keep the plating solution clean, the anode may be contained in a porous bag. It is usual to provide continuous by-passing with filtration of commercial nickel plating solutions and the solutions of the present invention are no exception. Agitation of the solution is usual during nickel plating, and the solutions of the present invention benefit from agitation.

The method of the present invention is such that the average current density on the objects being plated is generally in the range of 50 to 800 Amps per square meter. For decorative rack plating a cathodic current density of about 430 Amps per square meter is typically used. For optimum plating rates and nickel savings made possible by this invention, the average current density used will coincide with the critical current density for the appropriate nickel plating solution.

While we do not wish to be bound by any theory, we believe that the complexant effectively ties up some of the nickel in the electroplating solution, so that it is not available for deposition at high current densities. The effect is that plating efficiency is unimpaired up to the selected critical current density, and is progressively impaired at current densities above that figure, with the result that the throwing power of the solution is improved. The critical cathodic current density above which this effect occurs is controlled by several factors, viz. nickel concentration, complexent concentration, or more specifically the ratio of one to the other, pH, temperature, and degree of agitation. By control of these parameters as hereinbefore described, it is possible to arrange for the improved throwing power properties to be manifested above any desired critical current density. For decorative rack plating, the optimum value of the critical current density is about 430 Amps per square meter. For other applications, a higher or lower critical cathodic current density may be appropriate, and solution compositions and operating conditions can be selected for such applications.

By means of the present invention, a balanced solution can be provided which will cause the rate of electrodeposition of nickel to be substantially the same on all areas exposed to current densities above the critical value. A typical rate of electrodeposition of nickel when operating according to the present invention is 30 microns per hour.

The following Examples illustrate the invention.

EXAMPLE 1

The following solution was examined using a Hull Cell test 30 gm/1 Ni++ as chloride: (0.5 M)
45 gm/1 boric acid
75 gm/1 glycolic acid: (1.0 M)
pH = 5.8
Temperature = 38° C.

A current of 2A was passed through the solution in a Hull Cell for two minutes using 5 Volts potential, with a nickel anode and air agitation at the cathode. Semi bright metal was obtained over the entire current density range. The thickness distribution of the metal was determined coulometrically and is shown in the following Table

| Current density A/m$^2$ | 120 | 250 | 400 | 750 | 880 | 950 |
|---|---|---|---|---|---|---|
| Thickness μm | 0.30 | 0.62 | 1.25 | 1.32 | 1.33 | 1.30 |

By way of comparison, a standard Watt's Nickel bath was examined under identical conditions and the following thickness distribution was obtained

| Current density A/m$^2$ | 125 | 250 | 400 | 700 | 800 | 900 |
|---|---|---|---|---|---|---|
| Thickness μm | 0.33 | 0.65 | 1.26 | 2.40 | 2.06 | 2.70 |

The deposit was dull above 450 A/m$^2$.

EXAMPLE 2

An equivalent formulation to Example 1 was prepared except that 70 gm/1 glycine (0.93 M) replaced the glycolic acid. The same operating conditions were employed and the following metal distribution obtained.

| Current density A/m$^2$ | 120 | 240 | 400 | 700 | 850 | 950 |
|---|---|---|---|---|---|---|
| Thickness μm | 0.30 | 0.61 | 1.25 | 1.20 | 1.20 | 1.19 |

EXAMPLE 3

An equivalent formulation to Example 1 was prepared using 80 gms citric acid 0.4 M instead of glycolic acid. The same operating conditions were employed and the following metal distribution obtained.

| Current Density A/m$^2$ | 130 | 250 | 500 | 700 | 900 |
|---|---|---|---|---|---|
| Thickness μm | 0.35 | 0.66 | 1.30 | 1.38 | 1.43 |

EXAMPLE 4

The composition of Example 1 was used with 50 g/1 potassium chloride added. The metal distribution was identical but the Hull Cell voltage was reduced to 3V.

EXAMPLE 5

A solution of the following composition was evaluated using the Hull Cell Test as described in Example 1. The Cell voltage was 3.5V and temperature 40° C.

30 g/l Ni++ as chloride
25 g/l NaCl
100 g/l Glycolic acid

The thicknesses obtained at various current densities was measured at various pH values of the solution

| Current density A/m$^2$ | | 120 | 240 | 400 | 700 | 900 | 1000 |
|---|---|---|---|---|---|---|---|
| Thickness μm | pH = 3.0 | 0.30 | 0.60 | 1.20 | 2.40 | 2.00 | 1.80 |
| | pH = 4.0 | 0.31 | 0.60 | 1.25 | 2.38 | 2.40 | 2.43 |
| | pH = 5.0 | 0.31 | 0.60 | 1.26 | 1.50 | 1.40 | 1.40 |
| | pH = 5.5 | 0.30 | 0.60 | 1.26 | 1.33 | 1.33 | 1.30 |
| | pH = 6.5 | 0.31 | 0.60 | 1.16 | 1.20 | 1.10 | 1.05 |

The solution having the optimum throwing power was operated at pH = 5.5. At pH 6.5 overall efficiences were reduced.

EXAMPLE 6

A solution was formulated and tested as in Example 5 at pH = 5.5 but at various temperatures

| Current density A/m$^2$ | 120 | 240 | 400 | 800 | 1000 |
|---|---|---|---|---|---|
| Temp | | | | | |
| 25° | 0.28 | 0.56 | 1.20 | 1.10 | 1.05 |
| 40° | 0.30 | 0.62 | 1.26 | 1.28 | 1.24 |
| 55° | 0.32 | 0.65 | 1.30 | 1.35 | 1.55 |

EXAMPLE 7

A solution was formulated as in Example 5 and operated at 42° C. and pH = 5.5 but with and without air agitation.

| Current density A/m$^2$ | Thickness μm | |
|---|---|---|
| | Air agitation | No air agitation |
| 120 | 0.31 | 0.30 |
| 240 | 0.60 | 0.60 |
| 400 | 1.26 | 0.95 |
| 800 | 1.32 | 0.98 |

EXAMPLE 8

A solution of the following composition was made up and tested using the Hull Cell. Hull Cell current was 2A and plating time was five minutes.

35 g/l Nickel as chloride
180 g/l monosodium glutamate
pH = 5.5
Temperature = 40° C.

| Current density A/m² | 200 | 400 | 600 | 800 |
|---|---|---|---|---|
| Deposit thickness μm | 1.3 | 2.8 | 3.0 | 2.9 |

EXAMPLE 9

A solution as in Example 5 was evaluated using 140 g/l gluconolactone instead of glycolic acid. In Hull Cell under the same electrolysis conditions the following results were obtained.

| Current density A/m² | | 120 | 240 | 400 | 700 | 900 | 1000 |
|---|---|---|---|---|---|---|---|
| Thick-ness μm | pH = 5.0 | 0.32 | 0.64 | 1.29 | 1.33 | 1.32 | 1.29 |
| | pH = 5.8 | 0.30 | 0.60 | 1.23 | 1.26 | 1.20 | 1.10 |
| | pH = 6.0 | 0.26 | 0.51 | 1.11 | 1.11 | 1.11 | 1.08 |

EXAMPLE 10

A solution of the following composition was made up and tested in the Hull Cell using a current of 2Amps at a temperature of 40° C. and a plating time of 5 minutes.

35 grams per liter nickel as chloride
80 grams per liter sodium acetate
25 grams per liter sodium chloride
pH 5.5

| Current density A/m² | 100 | 400 | 600 | 800 | 1000 |
|---|---|---|---|---|---|
| Deposit thickness μm | 0.5 | 2.1 | 2.3 | 2.5 | 2.5 |

EXAMPLE 11

A solution of the following composition was made up and tested in the Hull Cell using a current of 2 Amps at a temperature of 40° C. and a plating time of 5 minutes.

35 grams per liter nickel as chloride
120 grams per liter gluconic acid
25 grams per liter sodium chloride
pH 5.5.

| Current density A/m² | 100 | 400 | 600 | 800 | 1000 |
|---|---|---|---|---|---|
| Deposit Thickness μm | 0.5 | 2.25 | 2.55 | 2.55 | 2.30 |

EXAMPLE 12

A solution of the following composition was made up and tested in the Hull Cell using a current of 2 Amps at a temperature of 40° C. and a plating time of 5 minutes.

35 grams per liter nickel as chloride
80 grams per liter sodium formate
25 grams per liter sodium chloride
pH 5.5

| Current density A/m² | 100 | 200 | 400 | 800 |
|---|---|---|---|---|
| Deposit thickness μm | 0.5 | 1.2 | 2.2 | 2.5 |

All Examples employed the same Hull Cell.

What we claim is:

1. A method of electrodepositing nickel on an object having a metallic surface, which method comprises providing a nickel electroplating bath consisting essentially of, in aqueous solution at a pH of from 4.0 – 6.5:

| Constituent | Molar Concentration |
|---|---|
| Nickel ions | at least 0.25 |
| Chloride | at least 0.25 |
| Sulphate (optional) | less than 0.25 |

and a weak complexant for the nickel selected from citrate, glutamate, anions and lactones of polyhydroxy C5 and C6 acids, and anions and lactones of acids having the formula $$X(C_nH_{2n})COOH$$

where

X is OH or $NH_2$ and n is 1 to 5, present at a Molar concentration of from 1.0 to 4.0 times that of the nickel, providing the object as the cathode to be plated in the bath, and an anode, and passing an electric current between the anode and the cathode.

2. A method as claimed in claim 1, wherein the nickel ion concentration is from 0.3 to 0.6 Molar.

3. A method as claimed in claim 1, wherein the weak complexant is a glycolate.

4. A method as claimed in claim 1, wherein the bath contains also boric acid at a concentration of from 30 to 60 grams per liter and/or one or more conductivity salts at a concentration of up to 2 Molar.

5. A method as claimed in claim 1, wherein the cathode is of copper, copper-plated zinc, brass or steel and is plated to a thickness of at least 10 microns.

6. A method as claimed in claim 1, wherein the bath is operated at a temperature of from 35° to 50° C.

7. A method as claimed in claim 1, wherein the current density at all points on the cathodic object being plated is from 50 to 800 Amps per square meter.

* * * * *